US011096478B2

(12) United States Patent
Vankov

(10) Patent No.: US 11,096,478 B2
(45) Date of Patent: Aug. 24, 2021

(54) DEVICE FOR FILAMENT END-ROUNDING AND A METHOD FOR END-ROUNDING TOOTHBRUSH FILAMENTS

(71) Applicant: The Procter & Gamble Company, Cincinnati, OH (US)

(72) Inventor: Michael Vankov, Schmitten (DE)

(73) Assignee: The Procter & Gamble Company, Cincinnati, OH (US)

( * ) Notice: Subject to any disclaimer, the term of this patent is extended or adjusted under 35 U.S.C. 154(b) by 206 days.

(21) Appl. No.: 16/401,097

(22) Filed: May 1, 2019

(65) Prior Publication Data

US 2019/0254415 A1 Aug. 22, 2019

Related U.S. Application Data

(63) Continuation of application No. 15/173,192, filed on Jun. 3, 2016, now Pat. No. 10,314,389.

(30) Foreign Application Priority Data

Jun. 5, 2015 (EP) ..... 15170804
Apr. 15, 2016 (EP) ..... 16165550

(51) Int. Cl.
*A46D 9/02* (2006.01)
*A46D 1/00* (2006.01)
(Continued)

(52) U.S. Cl.
CPC ..... *A46D 9/02* (2013.01); *A46D 1/0284* (2013.01); *A46D 1/08* (2013.01); *A46B 9/04* (2013.01); *A46D 9/00* (2013.01)

(58) Field of Classification Search
CPC ..... A46D 9/02; A46D 1/0284; A46D 1/08; A46D 9/00; A46C 9/04
See application file for complete search history.

(56) References Cited

U.S. PATENT DOCUMENTS 2,227,126 A 12/1940 Cooke
2,554,777 A 5/1951 Dangin
(Continued)

FOREIGN PATENT DOCUMENTS

DE 102004054839 5/2006
WO WO199907255 2/1999
WO WO200294059 11/2002

OTHER PUBLICATIONS

Extended European Search Report and Search Opinion; Application Ser. No. 15170804.7; dated Nov. 23, 2015; 9 pages.
(Continued)

*Primary Examiner* — Shay Karls
(74) *Attorney, Agent, or Firm* — Vladimir Vitenberg

(57) ABSTRACT

An end-rounding device comprises a movable body comprising an abrasive surface; a gearing for transferring a movement from a motor to the movable body; a providing unit for providing a plurality of bristle filament ends to the abrasive surface, wherein the providing unit comprises a clamping unit for clamping a bunch of filaments, wherein the bunch comprises a multiple of filaments of a bristle tuft; wherein the abrasive surface has a diameter from 80 mm to 300 mm and comprises a concave curvature oriented in the direction of the clamping unit; and wherein the clamping unit is movably spaced from the abrasive surface at a distance. A method of smoothening bristle filament ends utilizes the end-rounding device.

16 Claims, 2 Drawing Sheets

(51) Int. Cl.

| | |
|---|---|
| ***A46D 1/08*** | (2006.01) |
| *A46D 9/00* | (2006.01) |
| *A46B 9/04* | (2006.01) |

(56) References Cited

U.S. PATENT DOCUMENTS

| | | | | | |
|---|---|---|---|---|---|
| 3,416,262 | A | * | 12/1968 | Hazelton | A46D 9/00 451/194 |
| 3,451,173 | A | * | 6/1969 | Hazelton | A46D 9/02 451/28 |
| 3,619,953 | A | | 11/1971 | Hosoya | |
| 4,869,277 | A | | 9/1989 | Olsen | |
| 5,020,551 | A | | 6/1991 | Guerret | |
| 5,165,761 | A | | 11/1992 | Dirksing | |
| 5,176,427 | A | * | 1/1993 | Weihrauch | A46D 9/02 300/10 |
| 5,593,213 | A | * | 1/1997 | Meessmann | A46D 9/025 300/21 |
| 6,464,301 | B1 | | 10/2002 | Clos | |
| 2016/0353874 | A1 | | 12/2016 | Vankov | |

OTHER PUBLICATIONS

Extended European Search Report and Search Opinion; Application Ser. No. 16165550.1; dated Jul. 1, 2016; 5 pages.
International Search Report and Written Opinion; Application Ser. No. PCT/US2016/035623; dated Aug. 16, 2016; 11 pages.
"All Office Actions, U.S. Appl. No. 15/173,192".

* cited by examiner

DEVICE FOR FILAMENT END-ROUNDING AND A METHOD FOR END-ROUNDING TOOTHBRUSH FILAMENTS

FIELD OF THE INVENTION

A device for filament end-rounding, in particular for bristle filament end-rounding is described herein, wherein the bristle filaments are suitable to be used in brushes, in particular in toothbrushes. Said end-rounding device comprises a concavely formed movable body including an abrasive surface. The abrasive surface material may be applied onto the movable body or the movable body may comprise the abrasive material itself. In addition, a method for smoothening bristle filament ends, in particular for end-rounding bristle filaments is described, wherein said method can be used to provide filaments suitable for toothbrush production. Toothbrushes having tufts which are end-rounded as described herein provide a very smooth and equalized surface of each individual filament bristle with only small divergences over the tufts.

BACKGROUND OF THE INVENTION

Toothbrushes generally include bristle tufts made of a plurality of bristle filaments mounted onto the head of an oral brush handle. During the manufacturing of the brush heads, the bristles for said bristle tufts are cut from longer bristle filament strands into the required length. Thereby, sharp and irregular edges are generated at the bristle ends which might cut or irritate the oral surfaces, in particular the gums and the gum lines. Depending on the manufacturing technique both ends of a bristle become working ends (i.e. —the ends that contacts the teeth and gums) or only one end of the bristle will contact the oral surfaces after being mounted into the final brush head. That means at least the working ends of the bristles have to be smoothened in order to remove the sharp edges produced during cutting into working length. This smoothening process is known as end-rounding.

End-rounding of the bristle filaments can be performed at different time points during the manufacturing proceedings. In anchor tufted brush heads, the bristles are pre-cut, folded into two and then clamped into a blind-hole at the brush head using a metal wire. After all bristle tufts have been mounted onto the brush head by anchor tufting, the final tuft profile is cut and the bristle ends of the whole tuft pattern are end-rounded (U.S. Pat. Nos. 3,416,262 A1, 2,227,126 A1, 3,619,953 A1, 2,554,777 A1). If anchor-free mounting techniques are used, one of the bristle ends is mounted into the brush head or a part thereof and only the opposite bristle end is used as working end. Usually, in these manufacturing procedures the bristles are cut and end-rounded at the working end before they are mounted into the brush head or the part thereof, e.g. using an end-rounding device as disclosed in DE 10 2004 054 839 A1.

Nowadays complexity of bristle tuft pattern and surface profile with respect to the whole brush as well as with respect to the individual bristle tufts continuously increases. In addition, very smooth and sensitive toothbrushes are needed for people with hyposensitive gums and gum lines. Thus, smoothening, in particular end-rounding of bristles have to meet high quality standards.

In most end-rounding methods, the working ends of the bristles are contacted with an abrasive material, such as a sanding disc, which is rotated using an electric motor. For example an abrasively coated and convex formed disc which is mounted for rotation about a central axis is used in commonly known end-rounding apparatus (U.S. Pat. No. 3,451,173 A). Later on said convex formed disc were amended into triangular shaped disc, wherein the end-rounding was performed with one of the flat, but angled, surfaces (U.S. Pat. No. 5,165,761 A). Alternatively, rotating cylinders having an abrasive surface can be used (WO 1999/07255 A1). The drive systems for the rotating abrasives may be commonly known electric motors or higher sophisticated driving systems, such as an air driven planetary gear system (WO 2002/94059 A1).

During the end-rounding proceedings not only the individual bristles have to be smoothened sufficiently, but also the quality of end-rounding should not deviate significantly over the complete tuft or tuft pattern. The more bristle filaments are end-rounded in one process step, the more discrepancies arise regarding the end-rounding result of the individual bristle. In particular this problem exists, if higher numbers of bristles filaments, such as provided by filament hanks or hanklets, are end-round in parallel. Thus, a continuous need exists to improve end-rounding equipment and end-rounding methods, in particular with respect to end-rounding equipment or end-rounding methods which can be used for higher numbers of bristle filaments.

SUMMARY OF THE INVENTION

An end-rounding device comprises a movable body comprising an abrasive surface; a gearing suitable to transfer a movement from a motor to the movable body; a providing unit, suitable to provide bristle filament ends to the abrasive surface, wherein the providing unit comprises a clamping unit suitable to clamp a bunch of filaments, wherein the bunch comprises a multiple of filaments of a bristle tuft; wherein the abrasive surface has a diameter in the range of 80 mm to 300 mm and comprises a concave curvature which is oriented in the direction of the clamping unit and wherein the clamping unit is movable spaced from the abrasive surface with a distance.

According to another aspect, a method of smoothening bristle filament ends is disclosed, comprising the steps of providing first ends of bristle filaments of a filament bunch to an end-rounding device as disclosed herein, wherein the bunch comprises a multiple of bristle filaments of a bristle tuft arranged in parallel to each other; end-rounding the first ends by contacting them with an abrasive surface of a movable body of the end-rounding device; moving the surface over the first ends for a predefined time and optionally cutting a section from the bunch comprising the first ends and bristle filaments of a predefined length.

According to another aspect, a brush head, in particular, a toothbrush head, is disclosed, comprising one or more bristle tufts comprising bristle filaments, wherein the ends of the bristle filaments of the one or more bristle tufts are end-rounded using the method as disclosed herein and the deviation of end-rounding quality of the bristle filaments of one bristle tuft is at least less than 30%.

DETAILED DESCRIPTION OF THE INVENTION

Figure 1:
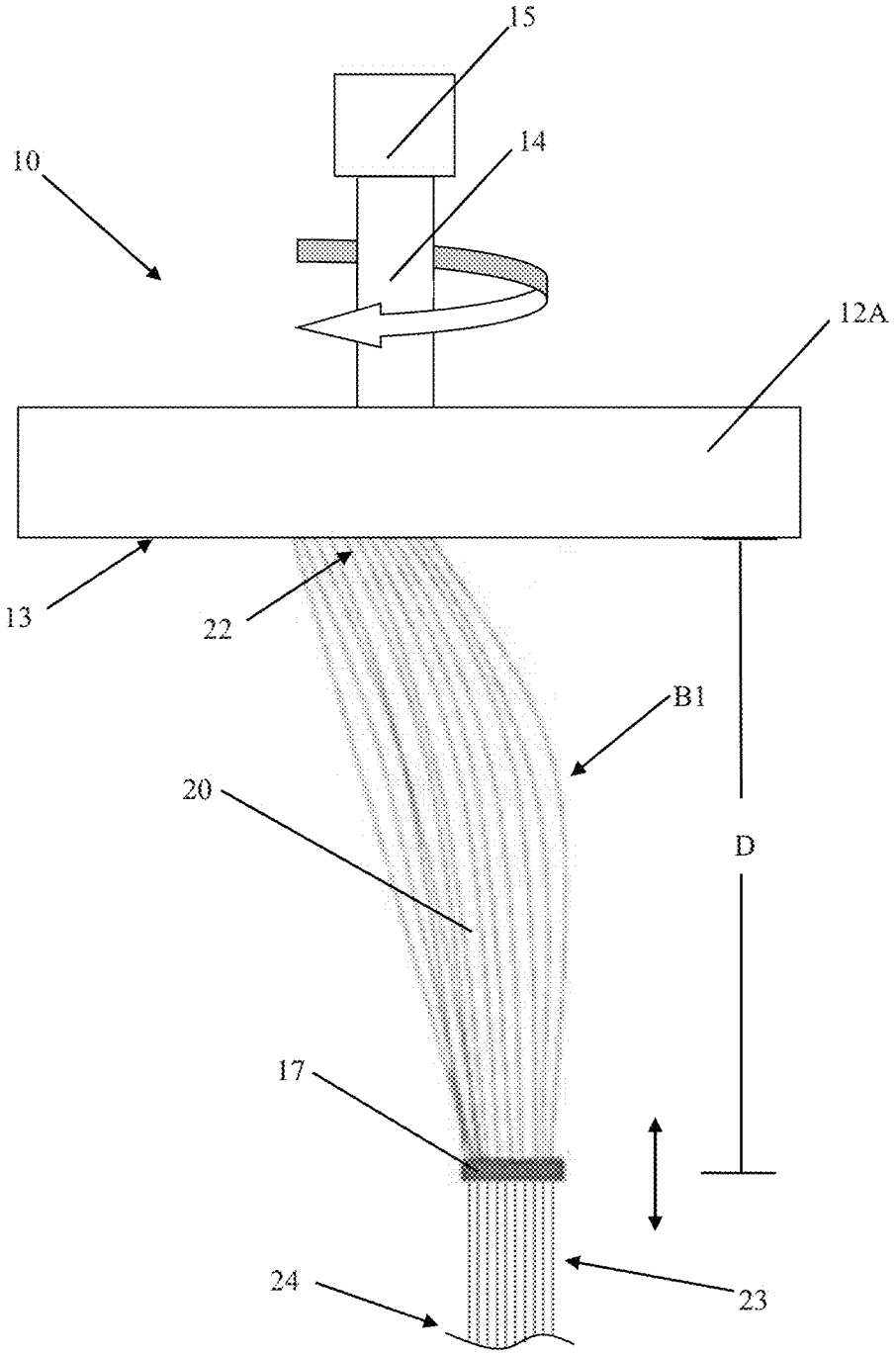
FIG. 1 shows a schematic side view of an end-rounding device 10 according to the prior art.

The following is a description of numerous embodiments of a method for smoothening, in particular end-rounding, bristle filament ends using a concave shaped abrasive surface. The description further discloses an end-rounding device providing a concave shaped abrasive surface which therefore can be also used in the method as disclosed herein. The description is to be construed as exemplary only and does not describe every possible embodiment since describing every possible embodiment would be impractical, if not impossible, and it will be understood that any feature, characteristic, structure, component, step or methodology described herein can be deleted, combined with or substituted for, in whole or in part, any other feature, characteristic, structure, component, product step or methodology described herein. In particular, features, characteristics, structures, components, or method steps described together with the device can also be applied to the method and vice versa.

In accordance with one aspect of the disclosure, there is provided a method for smoothening bristle filament ends. In particular, there is provided a method for end-rounding bristle filament ends. "Smoothening" as understood herein shall describe any equalizing and removing of sharp edges which arise at bristle filament ends after cutting. "End-rounding" as understood herein shall describe altering the shape of a bristle filament end into a substantially dome-shaped end, thereby removing any sharp edges. For end-rounding bristle filament ends are usually brought into contact with an abrasive moving surface. Thereby the filament are bent along there length axis due to the grinding pressure. If more than one bristle filament end shall be processed in parallel, such as a plurality of bristle filaments, the bending is different over the filament group if all filament ends are located at one level. Then the curvature of the filaments located at the periphery is bigger than the curvature of the filaments in the center of the filament group which is end-rounded. Thus, an increasing grinding pressure acts on the filament ends from the periphery to the center of the filament group. As a result, the grinding is different so that the end-rounding quality and the length of the end-rounded filaments are different as well. The term "end-rounding quality" as understood herein shall describe how perfect the dome-shaped form is met and how smooth the filament surface is. If a bristle filament group is processed in parallel the end-rounding quality achieved with the method as disclosed herein is constant over all individual bristle filaments ends processed as one group although the filament ends are arranged at one level.

Bristles filaments which can be smoothened according to the method as disclosed herein may be for example monofilaments made from plastic material. Suitable plastic material used for bristle filaments may be polyamide (PA), in particular nylon, polybutylterephthalate (PBT), polyethylterephthalate (PET), or mixtures thereof. In addition, the filament material may comprise additives such as abrasives, color pigments, flavors etc. For example, an abrasive such as kaolin clay may be added, and/or the filaments may be colored at the outer surface in order to realize indicator material. The coloring on the outside of the material is slowly worn away as the filament is used over time to indicate the extent to which the filament is worn. Suitable additives are for example UV-brighteners, signaling substances, such as the indicator color pigments and/or abrasives.

The diameter of the bristle filaments may be in the range from about 0.01 mm to about 0.3 mm, in particular in the range from about 0.05 mm to about 0.2 mm, more particular in the range of about 0.1 mm to about 0.16 mm or any other numerical range which is narrower, and which falls within such broader numerical range, as if such narrower numerical ranges were all expressly written herein.

The lengths of the bristles and/or bristle filaments depend on the intended use. Generally, a bristle filament can be of any suitable length for transporting; that means bristles are not manufactured as bristles of a pre-defined length per se, but as a continuous filament strand which is provided in roles or in large pieces of such strands.

Bundles of bristle filaments which are arranged in parallel and which are grouping a multiple of filaments which are usually used in one bristle tuft are understood herein as a "bunch". Thus, commercially available "hanks" or "hanklets" are described below in detail may represent a bunch as understood herein: Additionally or alternatively, different numbers of bristle filaments than those grouped in a hank or a hanklet may be combined to a filament bunch as used herein. Bristle filament strands are commercially available as hanks. A bristle filament "hank" as understood herein is an arrangement of a plurality, namely about 40000 to about 80000, bristle filaments which are all arranged with parallel length axis. The number of bristle filaments to be combined to one hank depends on the diameter of the individual bristle filament. The length of the hank may be determined by handling requirements as longer hanks are handled more difficultly and from shorter hanks less bristles can be achieved. The diameter of a hank is defined by the diameter and the number of the bristles forming one hank and the free space between the round filaments. Usually about 70% of a hank are filled with the bristle filaments. A suitable diameter of a hank is in the range of from about 40 mm to about 60 mm, preferably in the range of from about 45 mm to about 55 mm, more preferred in the range of from about 48 mm to about 52 mm. For example, a suitable hank may have a length of about 1200 mm. The outer surface of the hank may be covered with an envelope, such as a plastic sheet.

Alternatively, less bristle filaments can be combined to one hanklet. A "hanklet" as understood herein is an arrangement of a smaller plurality of bristle filaments than a hank. In a hanklet about 7,000 to about 10,000 bristle filaments or even less bristle filaments are arranged with parallel length axis. The length of the hanklet may be equal to the length of a hank or a hanklet may be longer. The diameter of a hanklet is defined by the diameter and the number of the bristles forming one hanklet and the free space between the bristles, usually about 30%. For example, a suitable hanklet may have a length of about 3000 mm. The outer surface of the hank may be covered with an envelope, such as a plastic sheet.

From a hank and or a hanklet sections of a predefined length can be cut. One of these sections is called herein a "puk" and comprises a plurality of bristle filaments in a predefined length. Said predefined length is at least the length of the longest bristle filament arranged in the final brush plus the length of the bristle incorporated into the brush head. Additionally or alternatively, the puk may also comprise the doubled length of the final bristle length for anchor based tufting. In addition, the length may be slightly larger than the length needed for the longest bristle for amendments of the bristle ends. A suitable length of a puk, corresponding to the length of the individual bristles provided therein may be in the range from about 5 mm to about 20 mm, in particular in the range from about 7 mm to about 17 mm, more particular in the range of about 8 mm to about 15 mm or any other numerical range which is narrower and which falls within such broader numerical range, as if such narrower numerical ranges were all expressly written herein. These length ranges given apply to bristles intended to be used in anchor free brushes. In addition, the length of a bristle influences the bending forces needed to bend the bristle. Thus, the length of a bristle can be used to realize different stiffness of bristles in a brush pattern and can therefore be varied in small ratios.

The method of smoothening bristle filament ends, in particular, end-rounding bristle filament ends, as disclosed herein comprises providing a first end of a plurality of bristle filaments to an end-rounding device comprising at least a concave shaped movable body which comprises an abrasive surface. In addition, the method comprises end-rounding the first ends by contacting them with the abrasive surface of the movable body of the end-rounding device and moving the abrasive surface over the first ends for a predefined time. Thereby the filament ends are smoothened by grinding of the edges and forming a substantially dome-shaped end. A suitable end-rounding device is disclosed herein.

Due to the concave shape of the abrasive surface more than one filament end, in particular a plurality of filament ends can be end-rounded in parallel without losing end-rounding quality even if the filament ends of a large group of filaments, e.g. a bunch, are arranged at one level. Based on the grinding pressure the filaments are bent during the end-rounding proceedings. However, if the concave shaped abrasive surface is used the curvature of all filaments which are end-rounded together is equal independently from the location of the filament in the filament group. This is important as the bending curvature influences the grinding pressure, the grinding depth and the grinding area. As a result of the method as disclosed herein, including but not limiting to using the end-rounding device as disclosed herein, all grinding parameters are equally applied to the filament ends independently from the location of the filament in the filament group to be end-rounded together. Thus, using the method and/or the device as disclosed herein allows to achieve a high end-rounding quality independently form the number of bristle filaments end-rounded together in parallel.

According to the present method bristle filaments can be end-rounded as groups, such as one or more bristle tufts, as one or more super-tufts, as a tuft-field, as a puk, as a hanklet,as a hank or as a bunch of any suitable number of filaments. A "bristle tuft" as understood herein may be a group of bristle filaments having a predefined length. Suitable numbers of bristle filaments to form one bristle tuft may be for example in the range of about 10 to about 80, or in the range of about 15 to about 60, or in the range of about 20 to about 50, or in the range of about 25 to about 40, or any other numerical range which is narrower and which falls within such broader numerical range, as if such narrower numerical ranges were all expressly written herein. A suitable length of the bristle filaments in a bristle tuft is equal or shorter to the length of the bristle filaments in a puk. A "super-tuft" as understood herein shall mean a tuft which is comprised of several individual tufts, for example comprised of 1.5 to 3 tufts. A "tuft-field" as understood herein is an arrangement of several tufts.

If the bristle filaments are end-rounded as a hanklet or as a hank the method further comprises the step of cutting a section from the hank or hanklet, wherein the section comprises the first ends of the bristle filaments which are end-rounded. The section cut from the hank or the hanklet, —then called a puk—has a predefined length which is already specified herein.

Additionally or alternatively, the method of smoothening, in particular end-rounding, of bristle filament ends can be applied also to the second end of the filaments. "Second filament ends" as understood herein shall be the ends of a tuft, a super-tuft or a puk which were not end-rounded by performing the method as disclosed herein first.

The movement of the movable body which is used to end-round the bristle filament ends as disclosed herein may be a regular or an irregular movement. Suitable movements are rotation, such as circular rotation, elliptic rotation, planetary rotation, a sliding movement, a random movement or a combination thereof. Preferably, elliptic and/or planetary rotation is used.

The end-rounding, in particular the moving of the abrasive surface over the bristle filament ends, is performed for a predefined time, in particular for a time period in the range of about 5 sec to about 25 sec, preferably in the range of about 8 to about 20 sec, more preferred in the range of about 10 to about 15 sec.

Additionally or alternatively, the method of smoothening, in particular the method of end-rounding, is repeated. For example, the method is repeated once, twice or more using one or more end-rounding devices. If the method is repeated with each repetition step an equal abrasive or a less abrasive surface can be used, e.g. two high abrasive surfaces, three medium abrasive surfaces and three less abrasive surfaces are used in one end-rounding series successively. That means the grinding potential of the abrasive surface decreases so that the smoothness of the bristle filaments increases from each end-rounding step to the next end-rounding step. For initial smoothening particle size of the abrasive particles used at the abrasive surface may be in the range of from about 100 μm to about 200 μm, in particular in the range of from about 100 μm to about 150 μm, more particular in the range of from about 100 μm to about 120 μm or any other numerical range which is narrower and which falls within such broader numerical range, as if such narrower numerical ranges were all expressly written herein. For a second smoothening step particle size of the abrasive particles used at the abrasive surface may be in the range of from about 60 μm to about 100 μm, in particular in the range of from about 60 μm to about 80 μm, more particular in the range of from about 60 μm to about 70 μm or any other numerical range which is narrower and which falls within such broader numerical range, as if such narrower numerical ranges were all expressly written herein. For a third smoothening step, in particular a polishing step particle size of the abrasive particles used at the abrasive surface may be in the range of from about 10 μm to about 60 μm, in particular in the range of from about 10 μm to about 40 μm, more particular in the range of from about 10 μm to about 20 μm or any other numerical range which is narrower and which falls within such broader numerical range, as if such narrower numerical ranges were all expressly written herein.

According to another aspect there is provided an end-rounding device. Said end-rounding device can in particular be used to perform the method for smoothening bristle filament ends as disclosed herein. The end-rounding device comprises a movable body which is connected to a motor via a gearing. Said motor/gearing combination is suitable to move the movable body in a predefined movement. Suitable movements for end-rounding are rotation, elliptic rotation, planetary rotation, a sliding movement, a random movement or a combination thereof. For an optimal end-rounding an irregular movement, such as an elliptical or planetary rotation is preferred. Due to the irregular movement the bristle filaments ends to be smoothened are shuffled in their position slightly during the end-rounding process so that a more homogeneous end-rounding can be achieved.

The movable body comprises an abrasive surface. Said abrasive surface comprises abrasive particles such as ceramic particles, e.g. aluminum oxide, zirconium oxide, silicon carbide, chromium(III)-oxide, flint, garnet or emery, diamante particles or sapphire particles, preferably diamante or sapphire particles. The abrasive surface can be applied or mounted onto the movable body. Alternatively, the movable body is produced in such that the abrasive particles are introduced into its surface. Suitable materials to form the movable body are for example, steel, such as tool steel or stainless steel. Steel can be mixed with the abrasive particles in molten state. Alternatively, the abrasive surface may be applied as a coating to the movable body or may be mounted as a layer, such as sandpaper or a textile having an abrasive coating. Use of a coating or a mountable layer is preferred as these materials can be removed easily, if the abrasive surface is abraded.

Different kinds of abrasive surfaces may be used with the end-rounding device as disclosed herein. In particular, different grit sizes can be used. Principally, the bigger the abrasive particles the more material is removed from the bristle filament ends. Thus, it might be preferred to used different end-rounding steps one after the other using abrasive surfaces with decreasing particle size. Particle size of the abrasive particles used at the abrasive surface may be in the range of from about 100 μm to about 200 μm. For initial smoothening particle size of the abrasive particles used at the abrasive surface may be in the range of from about 100 μm to about 200 μm, in particular in the range of from about 100 μm to about 150 μm, more particular in the range of from about 100 μm to about 120 μm or any other numerical range which is narrower and which falls within such broader numerical range, as if such narrower numerical ranges were all expressly written herein. For a second smoothening step particle size of the abrasive particles used at the abrasive surface may be in the range of from about 60 μm to about 100 μm, in particular in the range of from about 60 μm to about 80 μm, more particular in the range of from about 60 μm to about 70 μm or any other numerical range which is narrower and which falls within such broader numerical range, as if such narrower numerical ranges were all expressly written herein. For a third smoothening step, in particular a polishing step particle size of the abrasive particles used at the abrasive surface may be in the range of from about 10 μm to about 60 μm, in particular in the range of from about 10 μm to about 40 μm, more particular in the range of from about 10 μm to about 20 μm or any other numerical range which is narrower and which falls within such broader numerical range, as if such narrower numerical ranges were all expressly written herein. If an end-rounding device as disclosed herein is used often the end-rounding quality is sufficient after two different abrasive surfaces have been used. The different abrasive surfaces can be arranged in one end-rounding device or in more end-rounding devices which are used one after the other.

The size of the movable body as disclosed herein is adapted to the number of bristle filaments end-rounded in one process step and the diameter of the bunch, e.g. hank or hanklet, respectively. The more bristle filaments shall be end-rounded in one step, the larger is the size of the movable body. Preferably the movable body as disclosed herein is a disc comprising a concave curvature. A suitable diameter for the movable body surface may be in the range of from about 80 mm to about 300 mm. For example, a suitable diameter for end-rounding of hanklets are in the range of from about 80 mm to about 120 mm, preferably in the range of from about 90 mm to about 110 mm, more preferred about 100 mm or any other numerical range which is narrower and which falls within such broader numerical range, as if such narrower numerical ranges were all expressly written herein. Alternatively, a suitable diameter for end-rounding of hanks are in the range of from about 150 mm to about 250 mm, preferably in the range of from about 180 mm to about 220 mm, more preferred in the range of from about 190 mm to about 210 mm, more preferred about 200 mm or any other numerical range which is narrower and which falls within such broader numerical range, as if such narrower numerical ranges were all expressly written herein.

Due to the concave curvature at the abrasive surface of the movable body a high and homogeneous end-rounding quality over larger group of end-rounded filaments can be achieved. For end-rounding the filament ends have to be pressed against the abrasive surface of the end-rounding device. Thereby, the filament is bent along its length axis. If more than one bristle filament end shall be processed in parallel, for example a bunch of filaments, or a hanklet or a hank the bending is different over the filament group. The curvature of the filaments located at the periphery is bigger than the curvature of the filaments in the center of the filament group which is end-rounded. Thus, an increasing grinding pressure acts on the filament ends from the periphery to the center of the filament group if flat grinding surfaces are used. As a result, the grinding is different so that the end-rounding quality and the length of the end-rounded filaments are different as well. In contrast, the concave abrasive surface of the present end-rounding device compensates said end-rounding irregularity. Thus, the concave curvature is adapted to the bending angle of the filaments ends which are presented to the end-rounding device so that an equalized grinding pressure is applied to all filament ends of one group. The concave curvature of the present end-rounding device may be a regular or an irregular. For example, the concave curvature may be a circular curvature, an elliptic curvature, a completely irregular curvature or a mixture thereof. Suitable circular curvatures have a curvature radius in the range of from about 400 mm to about 700 mm, preferably in the range of from about 450 mm to about 650 mm, more preferred in the range of from about 500 mm to about 600 mm or any other numerical range which is narrower and which falls within such broader numerical range, as if such narrower numerical ranges were all expressly written herein.

With a distance from the abrasive surface a providing unit is arranged in the end-rounding device as disclosed herein. The providing unit is suitable to provide one or more bristle filaments to the abrasive surface. Form and functionality of the providing unit are adapted to number and form of bristle filaments presented. For example, if a hank or a hanklet shall be end-rounded the providing unit may comprise at least a clamping unit. A suitable clamping unit is e.g. a clamping ring. Said clamping unit stabilizes the plurality of bristle filaments in a predefined form, e.g. as a round bundle, and provides the filament ends to the abrasive surface of the end-rounding device. Thereby, the clamping unit can be arranged at any distance from the surface. The larger the distance of the clamping unit from the abrasive surface, the larger is the curvature of the bent filaments. In addition, the number of filaments clamped also influences stability and bending of the filaments. Principally, the filaments have to bended enough during the end-rounding so that all filaments of one bunch, hank or hanklet etc. are end-rounded homogeneously. Suitable distances between the clamping unit and the abrasive surface for a hank are in the range of from about 40 mm to about 100 mm, preferably in the range of from about 50 mm to about 90 mm, more preferred in the range of about 70 mm or any other numerical range which is narrower and which falls within such broader numerical range, as if such narrower numerical ranges were all expressly written herein. A suitable distance between the clamping unit and the abrasive surface for a hanklet may be the same as for a hank or may be smaller. Preferably the distance between the clamping unit and the abrasive surface for a hanklet is smaller than the distance used for the hank. Suitable distances between the clamping unit and the abrasive surface for a hanklet are in the range of from about 20 mm to about 50 mm, preferably in the range of from about 25 mm to about 45 mm, more preferred in the range of about 30 mm to about 40 mm or any other numerical range which is narrower and which falls within such broader numerical range, as if such narrower numerical ranges were all expressly written herein. The distance between the clamping unit and the abrasive surface may be varied during the end-rounding process in order to increase or decrease the bending of the filaments during the end-rounding. Thereby, the end-rounding quality can be improved; in particular a more homogeneous end-rounding over the complete hank or hanklet can be achieved. Thereby distance variation depends on the type of the filament used. Suitable distance variations are for example in the range of from about plus/minus 5% to about plus/minus 20%, in particular from about plus/minus 10% to about plus/minus 15%.

Additionally or alternatively, individual tufts, or tuft groups can be end-rounded as well using an end-rounding device as disclosed herein. Suitable providing units for individual tufts or tuft group may be clamping units, or hole-plates into which the end not to be end-rounded is placed.

If individual tufts or tuft groups shall be end-rounded, a suitable distance between the providing unit and the abrasive surface depends on the length of the filament bristles to be end-rounded.

Additionally or alternatively, an anchor-tufted brush can be end-rounded with an end-rounding device as disclosed herein. In these cases, the distance between the abrasive surface and the providing unit arranging the brush head is determined by the length of the bristle tufts already arranged in the brush head. Suitable providing units for providing a brush head to the end-rounding device may be clamping units as well as conveying belts onto which the position of the brush heads is fixed.

Between the abrasive surface and the providing unit a cutting unit may be arranged. Said cutting unit is suitable to cut a section from the bristle filaments which have been end-rounded. Said section comprises the end-rounded first bristle filament ends and provide after cutting second filament ends which are sharp and not end-rounded. The cutting unit may be any sharp object which is able to divide one or more bristle filaments into two pieces. Suitable cutting units are for example blades, in particular sliding blades, rotating blades, hot blades or hot wires.

The cut section comprises filaments from a predefined length. Said predefined length corresponds to the length of the filaments in the brush head to be produced. That means, the predefined length is at least the length of the longest bristles arranged in the final brush plus the length of the part of the bristle incorporated into the brush head. Additionally or alternatively, the section may also comprise the doubled length of the bristles for anchor based tufting or the length may be slightly larger than the length needed for the longest bristle. A suitable length of a section, corresponding to the length of the individual bristles provided therein may be in the range from about 5 mm to about 20 mm, in particular in the range from about 7 mm to about 17 mm, more particular in the range of about 8 mm to about 15 mm or any other numerical range which is narrower and which falls within such broader numerical range, as if such narrower numerical ranges were all expressly written herein. These length ranges given apply to bristles intended to be used in anchor free brushes. In addition, the length of a bristle filament influences the bending forces needed to bend the bristle in the final brush. Thus, the length of a bristle filament can be used to realize different stiffness of bristles in a brush pattern. Thus, the length of the section may be adapted according to the final stiffness intended for the bristle filaments at the brush head.

According to another aspect there is provided a brush head, in particular a toothbrush head, comprising one or more bristle tufts comprising bristle filaments, wherein the ends of said bristle filaments of the one or more bristle tufts are end-rounded using the method and/or the device as disclosed herein. Said brush head, in particular said toothbrush heads show a high end-rounding quality over the individual tufts and the complete tuft pattern at the brush head. That means, the deviation of end-rounding quality of the bristle filament ends inside one bristle tuft and/or the deviation of end-rounding quality of the bristle filaments ends of different bristle tufts at one brush head is at least less than 30%, preferably less than 20%, more preferred less than 15%, more preferred less than 10%, most preferred less than 5%.

In the following, a detailed description of an example embodiment will be given. It is noted that all features described in the present disclosure, whether they are disclosed in the previous description of more general embodiments or in the following description of the example embodiment of the devices, even though they may be described in the context of a particular embodiment, are of course meant to be disclosed as individual features that can be combined with all other disclosed features as long as this would not contradict the gist and scope of the present disclosure. In particular, all features disclosed for either one of the end-rounding device or the method smoothening, in particular end-rounding bristle filaments may also be combined with and/or applied to the other one, if applicable.

FIG. 1 shows a schematic side view of an end-rounding device 10 according to the prior art. A movable body 12A is connected to a motor 15 via a gearing 14. Due to the gearing 14 the movable body 12A can be moved in a predefined movement. The movable body 12A comprises a flat abrasive surface 13 which is arranged in the direction of a providing unit 17. The providing unit 17 is spaced from the abrasive surface 13 with a Distance D, wherein the distance D is set based on the properties of the one or more bristle filaments 20 which shall be end-rounded. The providing unit 17 is suitable to provide the one or more bristle filaments 20 to the abrasive surface 13. In particular, first ends 22 of bristle filaments 20 are provided by the providing unit 17 to the abrasive surface 13, wherein second filament ends 24 are arranged at the opposite side of the providing unit 17. During the end-rounding process the bristle filaments 20 are pressed against the surface 13 and are moved by the movement of the movable body 12A. Thereby the bristle filaments 20 bent along their length axis. The curvature B1 is inhomogeneous as the bristle filaments 20 arranged at the outside of a bristle filament bunch 23 are bent more than the bristle filaments 20 arranged in the middle of a plurality of bristle filaments 20, if all filaments contact the planar surface 13 of the movable body 12A. Said differences in bending result in an inhomogeneous end-rounding of the filament ends 22 as the filament ends 22 are pressed differently against the abrasive surface 13. In addition, the filaments ends 22 positioned at the outside of the bunch 23 of filaments 20 to be end-rounded may be scratched along their length axis due to the higher bending.

Figure 2:
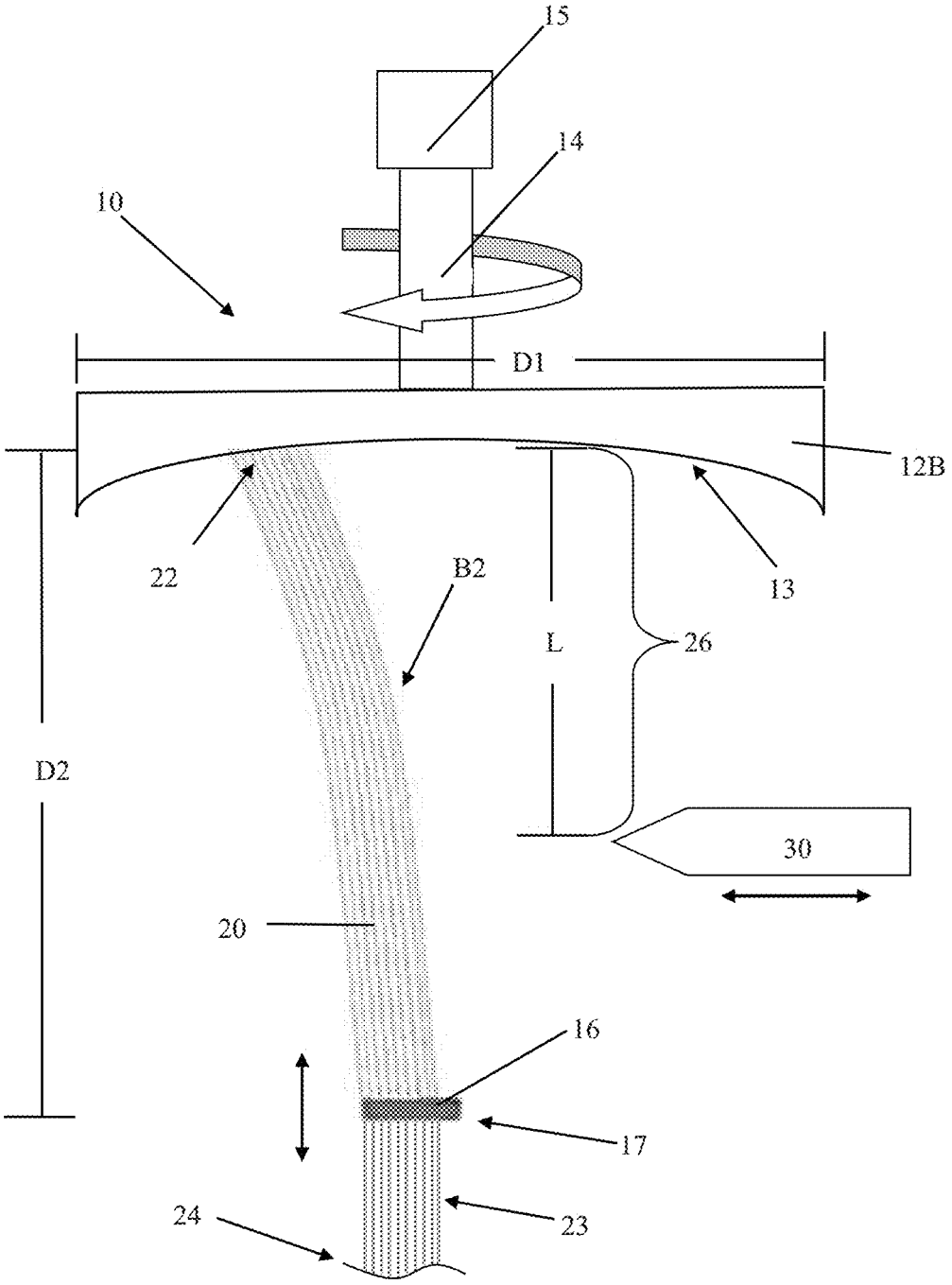
FIG. 2 shows a schematic side view of an end-rounding device 10 comprising a concavely formed abrasive surface 13.

FIG. 2 shows a schematic side view of an end-rounding device 10 according to the present disclosure. A movable body 12B is connected to a motor 15 via a gearing 14. Due to the gearing 14 the movable body 12B can be moved in a predefined movement. Suitable movements for end-rounding are regular or irregular rotation, a sliding movement or a combination thereof. For an optimal end-rounding result an irregular rotation, such as a planetary rotation is preferably used.

The movable body 12B comprises an abrasive surface 13 which is arranged in the direction of a providing unit 17 comprising a clamping unit 16. The abrasive surface 13 comprises abrasive particles such as diamante or sapphire particles. The abrasive surface can be applied or mounted onto the movable body 12B or the movable body 12B is produced in such that the abrasive particles are introduced into the abrasive surface 13. Suitable materials to form the movable body 12B are for example stainless steel into which the abrasives may be mixed. Alternatively, the abrasive surface 13 may be applied as a coating to the movable body 12B or may be mounted as a layer, such as sandpaper or a textile having an abrasive coating. Use of a coating or a mountable layer is preferred as these materials can be removed easily, if the abrasive surface is abraded. Different kinds of abrasive surfaces 13 may be use with the end-rounding device 10 as disclosed herein. In particular, different grit sizes can be used. If more than one end-rounding steps are used the particle size of the abrasive particles becomes smaller from step to step. A suitable particle size for a first end-rounding step is in the range of from about 100 μm to about 120 μm a suitable particle size for a second end-rounding step is in the range of from about 60 μm to about 70 μm. Usually, the end-rounding quality is sufficient after end-rounding with two different abrasives, but if a final polishing step is performed, it may use abrasive particles with a particle size in the range of from about 10 μm to about 20 m.

The providing unit 17 shown in FIG. 2 comprises a clamping unit 16 which clamps a filament bunch 23. The clamping unit 16 is spaced from the abrasive surface 13 with a Distance D2. The clamping unit 16 is suitable to provide a plurality of bristle filaments 20, e.g. a bunch 23, to the abrasive surface 13. In particular, first ends 22 of the bristle filaments 20 are provided by the clamping unit 16 to the abrasive surface 13, wherein second filament ends 24 are arranged at the opposite side of the clamping unit 16. If the filament bunch 23 clamped by the clamping unit 16 is a hank the distance D2 is in the range of about 70 mm. If the clamped filament bunch 23 is a hanklet the distance D2 is in the range of about 30 mm to about 40 mm. The distance D2 may be varied during the end-rounding process. In particular, the distance D2 may be varied about plus/minus 10% during the end-rounding. Due to the variation of the distance D2 a more homogeneous end-rounding over the whole number of bristle filaments 20 comprised in one hank, hanklet and/or bunch 23 can be achieved.

During the end-rounding process the bristle filaments 20 are pressed against the surface 13 by the clamping unit 16 and the bristle filaments 20 are moved by the movement of the movable body 12. Thereby the bristle filaments 20 bent along their length axis. The curvature B2 is homogeneous due to the curvature of the abrasive surface 13. The curvature of the abrasive surface 13 is a circular curvature with a curvature radius about 550 mm.

Between the abrasive surface 13 and the clamping unit 16 a cutting unit 30 may be arranged. Said cutting unit 30 is suitable to cut a section 26 from the bristle filaments 20. Said section 26 comprises the end-rounded first bristle filament ends 22 and provides after cutting second filament ends 24 which are sharp and not end-rounded. The cutting unit 30 may be any sharp object which is able to divide one or more bristle filaments into two pieces. Suitable cutting units 26 are for example blades.

The section 26 comprises filaments from a predefined length L. Said predefined length L corresponds to the length of the filaments 20 in the brush head to be produced. A suitable length of the individual bristles filament 20 which can be used in anchor-free brush heads may be in the range of from about 8 mm to about 15 mm. A suitable length L for filaments to be used in anchor tufted brush heads is about twice the length L of filaments for anchor-free brush heads.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An end-rounding device (10) comprising:

a movable body (12B) comprising an abrasive surface (13) and having an axis of rotation;

a gearing (14) structured and configured to transfer a rotational movement from a motor (15) to the movable body (12B);

a providing unit (17) structured and configured to provide a plurality of bristle filament ends (22) to the abrasive surface (13), wherein the providing unit (17) comprises a clamping unit (16) structured and configured to clamp a bunch (23) of filaments (20) having a length axis, wherein the bunch (23) comprises a plurality of filaments (20) of a bristle tuft;

wherein the abrasive surface (13) has a diameter (D1) from 80 mm to 300 mm and comprises a concave curvature oriented in the direction of the clamping unit (16) and wherein the clamping unit (16) is movably spaced from the abrasive surface (13) at a distance (D2) so that the axis of rotation of the movable body is substantially parallel to the length axis of the bunch of filaments.

2. The end-rounding device (10) of claim 1, wherein the concave curvature comprises a circular curvature having a curvature radius of from about 400 mm to about 700 mm.

3. The end-rounding device (10) of claim 1, wherein the concave curvature is selected from a circular curvature having a curvature radius of from about 450 mm to about 650 mm.

4. The end-rounding device (10) of claim 1, wherein the concave curvature is selected from a circular curvature having a curvature radius of from about 500 mm to about 600 mm.

5. The end-rounding device (10) according to claim 1, wherein the concave curvature is selected from the group consisting of a circular curvature, an elliptic curvature, an irregular curvature, and any combination thereof.

6. The end-rounding device (10) according to claim 1, wherein the abrasive surface (13) has a diameter (D1) from about 150 mm to about 250 mm.

7. The end-rounding device (10) according to claim 1, wherein the abrasive surface (13) has a diameter (D1) from about 180 mm to about 220 mm.

8. The end-rounding device (10) according to claim 1, wherein the abrasive surface (13) has a diameter (D1) from about 190 mm to about 210 mm.

9. The end-rounding device (10) according to claim 1, wherein the abrasive surface (13) has a diameter (D1) about 200 mm.

10. The end-rounding device (10) according to claim 1, wherein the distance (D2) between the clamping unit (16) and the abrasive surface (13) is from about 40 mm to about 100 mm.

11. The end-rounding device (10) according to claim 1, wherein the distance (D2) between the clamping unit (16) and the abrasive surface (13) is from about 50 mm to about 90 mm.

12. The end-rounding device (10) according to claim 1, wherein the distance (D2) between the clamping unit (16) and the abrasive surface (13) is about 70 mm.

13. The end-rounding device (10) according claim 1, wherein the end-rounding device (10) further comprises a cutting unit (30) structured and configured to cut bristle filaments (20) of a predefined length (L) from the filament bunch (23).

14. The end-rounding device (10) according to claim 1, wherein the clamping unit (16) comprises a clamping ring.

15. The end-rounding device (10) of claim 1, wherein the concave curvature comprises a circular curvature having a curvature radius of from about 450 mm to about 650 mm.

16. The end-rounding device (10) of claim 1, wherein the concave curvature comprises a circular curvature having a curvature radius of from about 500 mm to about 600 mm.

* * * * *